US005637816A

United States Patent [19]

Schneibel

[11] Patent Number: 5,637,816

[45] Date of Patent: Jun. 10, 1997

[54] METAL MATRIX COMPOSITE OF AN IRON ALUMINIDE AND CERAMIC PARTICLES AND METHOD THEREOF

[75] Inventor: Joachim H. Schneibel, Maryville, Tenn.

[73] Assignee: Lockheed Martin Energy Systems, Inc., Oak Ridge, Tenn.

[21] Appl. No.: 517,638

[22] Filed: Aug. 22, 1995

[51] Int. Cl.[6] ..... C22C 29/02; C22C 29/14; B22F 3/00

[52] U.S. Cl. ..... 75/240; 75/244; 75/246; 75/249; 419/12; 419/18; 419/60; 501/96.3

[58] Field of Search ..... 75/240, 244, 246, 75/249; 501/96; 419/39, 12, 18, 60

[56] References Cited

U.S. PATENT DOCUMENTS

| | | | |
|---|---|---|---|
| 4,859,124 | 8/1989 | Moskowitz et al. | 409/64 |
| 4,915,903 | 4/1990 | McKamey et al. | 420/79 |
| 4,961,903 | 10/1990 | Grupbacher et al. | 420/129 |
| 5,045,512 | 9/1991 | Lange et al. | 501/96 |
| 5,084,109 | 1/1992 | Sikka | 148/12 R |
| 5,093,148 | 3/1992 | Christodolou et al. | 427/37 |
| 5,238,645 | 8/1993 | Sikka et al. | 420/79 |
| 5,320,802 | 6/1994 | Liu et al. | 420/81 |
| 5,358,689 | 10/1994 | Ichikawa et al. | 420/590 |
| 5,382,405 | 1/1995 | Lowrance et al. | 505/125 |

OTHER PUBLICATIONS

"Iron Aluminum Phase Diagram" from *Binary Alloy Phase Diagrams,* T.B. Massalski, ed. (American Society for Metals, Metals Park, OH, 1986).

D.J. Gaydosh, S.L. Draper, and M.V. Nathal, "Microstructure and Tensile Properties of Fe–40 At. Pct Al Alloys with C, Zr, Hf, and B Additions," *Metallurgical Transactions A,* 20A (1989): 1701–1714.

S. Guha, P.R. Munroe, and I. Baker, "Room Temperature Deformation Behavior of Multiphase Ni–20at. %Al–30at. %Fe and Its Constituent Phases," *Materials Science and Engineering,* A131 (1991): 27–37.

A. Magnee et al., "Wear Resistance of the FeAl Intermetallic Alloy," *Sixth Japan Institute of Metals International Symposium on Intermetallic Compounds,* Sendai, Japan: The Japan Institute of Metals, 1991, 725–.

C.G. McKamey, J.H. DeVan, P.F. Tortorelli, and V.K. and Sikka, "A Review of Recent Developments in Fe3Al–Based Alloys," *J. Mater. Res.,* 6.8 (1991): 1779–1805.

C.G. McKamey and J.A. Horton, "The Effect of Molybdenum Addition on Properties of Iron Aluminides," *Metallurgical Transactions A,* 20A (1989): 751–757.

C.G. McKamey, J.A. Horton, and C.T. Liu, "Effect of Chromium on Room Temperature Ductility and Fracture Mode in Fe3Al," *Scripta Metallurgica* 22 (1988): 1679–1681.

C.G. McKamey, P. J. Maziasz, and J. W. Jones, "Effect of Addition of Molybdenum or Niobium on Creep–Rupture Properties of Fe3Al," *J. Mater. Res.* 7.8 (1992):2089–2106.

A.K. Misra, "Identification of Thermodynamically Stable Ceramic Reinforcement Materials for Iron Aluminides," *Metall. Trans. A,* 21A (1990): 441.

B.H. Rabin and R. N. Wright, "Synthesis of Iron Aluminides from Elemental Powders: Reaction Mechanisms and Densification Behavior," *Metall. Trans. A,* 22A (1991): 277.

H. Sugiyama, et al., "Amorphization of Intermetallic Compounds Dispersed in the Aluminum Matrix by Mechanical Alloying," Mat. Sci. Forum., vol. 88–90 (1992), pp. 361–366.

*Primary Examiner*—Ngoclan Mai
*Attorney, Agent, or Firm*—Ivan L. Ericson

[57] ABSTRACT

A metal matrix composite comprising an iron aluminide binder phase and a ceramic particulate phase such as titanium diboride, zirconium diboride, titanium carbide and tungsten carbide is made by heating a mixture of iron aluminide powder and particulates of one of the ceramics such as titanium diboride, zirconium diboride, titanium carbide and tungsten carbide in a alumina crucible at about 1450° C. for about 15 minutes in an evacuated furnace and cooling the mixture to room temperature. The ceramic particulates comprise greater than 40 volume percent to about 99 volume percent of the metal matrix composite.

10 Claims, No Drawings

METAL MATRIX COMPOSITE OF AN IRON ALUMINIDE AND CERAMIC PARTICLES AND METHOD THEREOF

This invention was made with Government support under contract DE-AC05-84OR21400 awarded by the U.S. Department of Energy to Martin Marietta Energy Systems, Inc. and the Government has certain rights in this Invention.

FIELD OF THE INVENTION

The present invention relates to a metal matrix composite and a method thereof, more particularly, to a metal matrix composite of an iron aluminide binder and ceramic particles and a method thereof.

BACKGROUND OF THE INVENTION

Current binder materials for composites, cermets or hard metals fabricated with various ceramic particles such as borides, carbides, nitrides, or oxides are primarily iron, cobalt, or nickel. While iron is inexpensive and readily available, its melting point is high, requiring high processing temperatures. Also, while iron does not react with $TiB_2$, it reacts with $ZrB_2$ to form tetragonal $Fe_2B$ and can thus not be used as a binder for $ZrB_2$. Alloys based on cobalt or nickel are more expensive than iron aluminides and cobalt and nickel alloys suffer from toxicity problems.

There is a need to provide a metal matrix composite which is an improvement over the above metal matrix composites.

U.S. Pat. No. 4,915,903 to Brupbacher et al and U.S. Pat. No. 5,093,148 to Christodoulou et al both discuss a metal matrix containing a second phase of particles. Both discuss that the intermetallic matrix may comprise a wide variety of intermetallic materials, with particular emphasis drawn to the aluminides and silicides and that Exemplary intermetallics include $Ti_3Al$, TiAl, $TiAl_3$, $Ni_3Al$, NiAl, $Nb_3Al$, $NbAl_3$, $Co_3Al$, $Zr_3Al$, $Fe_3Al$, $Ta_2Al$, $TaAl_3$, $Ti_5Si_3$, $Nb_5Si_3$, $Cr_3Si$, $CoSi_2$ and $Cr_2No$. Both discuss that the second phase particulate materials may comprise ceramics, such as borides, carbides, nitrides, oxides, silicides or sulfides, or may comprise an intermetallic other than the matrix intermetallic and that exemplary second phase particulates include $TiB_2$, $ZrB_2$, $HfB_2$, $VB_2$, $NbB_2$, $TaB_2$, $MoB_2$, TiC, ArC, HfC, VC, NbC, TaC, WC, TiN, $Ti_5Si_3$, $Nb_5Si_3$, $ZrSi_2$, $MoSi_2$, and $MoS_2$.

OBJECTS OF THE INVENTION

Accordingly, it is an object of the present invention to provide a metal matrix composite of an iron aluminide and ceramic particles and a method thereof. Further and other objects of the present invention will become apparent from the description contained herein.

SUMMARY OF THE INVENTION

In accordance with one aspect of the present invention, a new and improved metal matrix composite comprises a generally continuous intermetallic binder phase and a dispersed particulate phase throughout the generally continuous intermetallic binder phase. The generally continuous intermetallic binder phase has a melting point below the melting point of iron and wets titanium diboride, zirconium diboride, titanium carbide and tungsten carbide. The dispersed particulate phase comprises particulates of a ceramic selected from the group consisting of titanium diboride, zirconium diboride, titanium carbide, tungsten carbide and mixtures thereof. The dispersed particulate phase comprises greater than 40 volume percent to about 99 volume percent of the metal matrix composite. The generally continuous intermetallic binder phase comprises an iron aluminide with an aluminum content between about 10 and about 37 weight percent.

In accordance with another aspect of the present invention, a new and improved method for making a metal matrix composite comprises the following steps:

Step 1. A mixture of iron aluminide powder and particulates comprising ceramic particulates selected from the group consisting of titanium diboride, zirconium diboride, titanium carbide, tungsten carbide and mixtures thereof to form a powder mixture is provided.

Step 2. The powder mixture is heated in vacuum to form a metal matrix composite comprising a generally continuous iron aluminide binder phase and a particulate phase dispersed throughout the binder phase. The iron aluminide binder phase has a melting point below iron, cobalt, or nickel and wets titanium diboride, zirconium diboride, titanium carbide and tungsten carbide. The dispersed particulate phase comprises a ceramic selected from the group consisting of titanium diboride, zirconium diboride, titanium carbide, tungsten carbide and mixtures thereof.

In accordance with another aspect of the present invention, a new and improved article of manufacture comprises an article selected from the group consisting of wear parts and cutting tools. The article comprises a metal matrix composite comprising a generally continuous intermetallic binder phase and a particulate phase dispersed throughout the generally continuous intermetallic binder phase. The generally continuous intermetallic binder phase has a melting point below the melting point of iron, cobalt, or nickel and wets titanium diboride, zirconium diboride, titanium carbide and tungsten carbide. The dispersed particulate phase comprises particulates of a ceramic selected from the group consisting of titanium diboride, zirconium diboride, titanium carbide, tungsten carbide and mixtures thereof. The dispersed particulate phase comprises greater than 40 volume percent to about 99 volume percent of the metal matrix composite. The generally continuous intermetallic binder phase comprises an iron aluminide with an aluminum content between about 10 and about 37 weight percent.

DETAILED DESCRIPTION OF THE PREFERRED EMBODIMENTS

A new class of composites, hard metals or cermets based on an iron aluminide binder and ceramic particulates has been developed. Iron aluminides are intermetallic compounds with properties quite different from those of their elemental components, iron and aluminum. Outstanding features of these binders are their exceptionally good oxidation, corrosion, and sulfidation resistance, as well an extremely high work hardening rate. The unique properties of the iron aluminide binder will give these materials an advantage in aggressive environments. The binder in the present invention is an intermetallic compound which has a much better oxidation resistance than a mixture of iron, cobalt and nickel. Iron aluminide intermetallics with approximately 24.4 weight percent (40 atomic percent) aluminum do not react with $ZrB_2$ to form $Fe_2B$. They are much cheaper than alloys based on cobalt or nickel. They do not suffer from the toxicity problems associated with nickel or cobalt. Since they melt at significantly lower temperatures than alloys made of iron, cobalt, or nickel, the processing costs are reduced. As compared to iron, cobalt or nickel binders, iron aluminides exhibit unique oxidation, sulfidation, corrosion and abrasion resistance in various environments, which makes the corresponding composites, cermets, or hard metals particularly resistant to those environments. Also, composites, cermets, and hard metals made with iron aluminides exhibit high strength, hardness, abrasion resistance, and superior fracture toughness.

This invention relates to a composite material comprising a dispersed ceramic particulate phase, and a generally continuous binder phase. The binder phase comprises an intermetallic alloy of iron and aluminum. The aluminum content of the intermetallic alloy is from about 10 wt. % about 37 wt. % aluminum, more specifically, about 24.4 wt. % (40 atomic %) aluminum.

The composite material is made by mixing ceramic particulates and iron aluminide powder to form a powder mixture. The powder mixture is poured into a crucible or mold and compacted to form a green body. The green body is sintering at a temperature and for a period time sufficient to achieve equal to or greater than 95% of theoretical density.

The intermetallic iron aluminide matrix containing 24.4 wt. % aluminum in these composites was chosen for its unique properties. Its melting point is 1417° C. which is significantly below the melting points of iron (1535° C.), cobalt (1495° C.) or nickel (1455° C.). The melting point of iron aluminide ($Fe_3Al$) containing 13.8 wt. % aluminum is 1516° C. and iron aluminide (FeAl) containing 32.6 wt. % aluminum is 1322° C. The fracture toughness of intermetallic iron aluminide matrix containing 24.4 wt. % aluminum is comparable to that of high strength aluminum alloys. It wets titanium diboride, zirconium diboride, and titanium carbide extremely well, without significantly reacting with them. It exhibits outstanding oxidation, sulfidation, corrosion, and abrasion resistance in many environments. For these reasons a combination of iron aluminides and ceramic particulates is expected to exhibit special properties not achieved by other materials. Processing of iron aluminide composites may be carried out in a simple manner. Prealloyed iron aluminide powders may be mixed with ceramic powders. The powder mix is then either poured into a suitable ceramic crucible or consolidated, for example, by cold-pressing. The crucible containing the mixed powders or the consolidated green body are then inserted into a furnace which is evacuated and heated to a temperature sufficient to melt the iron aluminide. This results in shrinkage and densification. If the ceramic volume fractions are sufficiently high, the powder mass will maintain a shape similar to that given to it prior to the liquid-phase sintering step. Thus, near net shape processing is easily carried out. The resulting product exhibits high hardness, abrasion resistance, strength, and superior toughness.

EXAMPLE 1

A sample containing 76 wt. % of a iron aluminide alloy binder phase containing 24.4 wt. % (40 atomic %) aluminum and 24 wt % titanium diboride particulate phase was prepared by mixing iron aluminide powder containing 24.4 wt. % aluminum and titanium diboride powder to form a powder mixture. The powder mixture was placed in an alumina crucible and heated in an evacuated furnace to 1450° C., held at that temperature for 15 minutes, then cooled to room temperature. The measured density of the resulting material was 97% of the theoretical density.

EXAMPLE 2

A sample containing 67 wt. % of a iron aluminide alloy binder phase containing 24.4 wt. % aluminum and 33 wt % titanium diboride particulate phase was prepared by mixing iron aluminide powder containing 24.4 wt. % aluminum and titanium diboride powder to form a powder mixture. The powder mixture was placed in an alumina crucible, and heated in an evacuated furnace to 1450° C., held at that temperature for 2 hours, then cooled to room temperature. The measured density was, within experimental error, equal to the theoretical density.

EXAMPLE 3

A sample containing 80 wt. % of a iron aluminide alloy binder phase containing 24.4 wt. % aluminum and 20 wt. % zirconium diboride particulate phase was prepared by mixing iron aluminide powder containing 24.4 wt. % aluminum and zirconium diboride powder to form a powder mixture. The powder mixture was placed in an alumina crucible and heated in an evacuated furnace to 1450° C., held at that temperature for 15 minutes, then cooled to room temperature. The measured density of the resulting material was 97% of the theoretical density.

EXAMPLE 4

A sample containing 60 wt. % of a iron aluminide alloy binder phase containing 24.4 wt. % aluminum and 40 wt % zirconium diboride particulate phase was prepared by mixing iron aluminide powder containing 24.4 wt. % aluminum and titanium diboride powder to form a powder mixture. The powder mixture was placed in an alumina crucible and heated in an evacuated furnace to 1450° C., held at that temperature for 15 minutes, then cooled to room temperature. The measured density of the resulting material was 98% of the theoretical density.

EXAMPLE 5

A sample containing 50 wt. % of a iron aluminide alloy binder phase containing 24.4 wt. % aluminum and 50 wt % zirconium diboride particulate phases was prepared by mixing iron aluminide powder containing 24.4 wt. % aluminum and titanium diboride powder to form a powder mixture. The powder mixture was placed in an alumina crucible and heated in an evacuated furnace to 1450° C., held at that temperature for 15 minutes, then cooled to room temperature. The measured density of the resulting material was 97% of the theoretical density.

EXAMPLE 6

A sample containing 68 wt. % of a iron aluminide alloy binder phase containing 24.4 wt. % aluminum and 21 wt. % titanium diboride and 11 wt. % alumina particulate phases was prepared by mixing iron aluminide powder containing 24.4 wt. % aluminum, titanium diboride powder and alumina powder to form a powder mixture. The mixture was placed in an alumina crucible and heated in an evacuated furnace to 1450° C., held at that temperature for 15 minutes, then cooled to room temperature. The measured density of the resulting material was 94% of the theoretical density.

EXAMPLE 7

A sample containing 60 wt. % of a iron aluminide alloy binder phase containing 24.4 wt. % aluminum and 45 wt. % titanium carbide particulate phases was prepared by mixing iron aluminide powder containing 24.4 wt. % aluminum and titanium carbide powder to form a powder mixture. The powder mixture was placed in an alumina crucible and heated in an evacuated furnace to 1450° C., held at that temperature for 15 minutes, then cooled to room temperature. The measured density of the resulting material was 99% of the theoretical density.

EXAMPLE 8

A sample containing 67 wt. % of a iron aluminide alloy binder phase containing 24.4 wt. % aluminum and 33 wt % titanium diboride particulate phase was prepared by mixing iron aluminide powder containing 24.4 wt. % aluminum and titanium diboride powder to form a powder mixture. The powder mixture was placed in an alumina crucible and heated in an evacuated furnace to 1450° C., held at that temperature for 15 minutes, then cooled to room temperature. A bend specimen was machined from it and tested in three-point bending. The fracture strength was determined to be 968 MPa.

EXAMPLE 9

A sample containing 60 wt. % of a iron aluminide alloy binder phase containing 24.4 wt. % aluminum and 40 wt % zirconium diboride particulate phase was prepared by mixing iron aluminide powder containing 24.4 wt. % aluminum and titanium diboride powder to form a powder mixture. The powder mixture was placed in an alumina crucible and heated in an evacuated furnace to 1450° C., held at that temperature for 15 minutes, then cooled to room temperature. A bend specimen with a chevron-notch in it was tested in three-point bending and the fracture toughness was determined to be 32 MPa $m^{1/2}$. The hardness (Vickers hardness, 100 g load) of a sample with the same composition and fabricated in the same way was 850 $kg/mm^2$ (9 GPa).

EXAMPLE 10

A sample containing 67 wt. % of a iron aluminide alloy binder phase containing 24.4 wt. % aluminum and 33 wt % titanium diboride particulate phase was prepared by mixing iron aluminide powder containing 24.4 wt. % aluminum and titanium diboride powder to form a powder mixture. The powder mixture was placed in an alumina crucible and heated in an evacuated furnace to 1450° C., held at that temperature for 15 minutes, then cooled to room temperature. One surface of the resulting material was polished and its dry wear resistance was measured by the reciprocation motion of a silicon nitride ball pressed against it. As compared to a silicon nitride ball sliding on a silicon nitride substrate, the wear rate was reduced by a factor of 30.

The iron aluminide binder used in the present invention is unique in that it is an intermetallic compound with properties significantly different from those of iron or aluminum. It has a comparatively low melting point and outstanding oxidation, sulfidation, erosion and corrosion properties. The combination of the iron aluminide binder with a suitable ceramic particulate results in composites, cermets, or hard metals with outstanding oxidation, sulfidation, erosion, and corrosion properties.

The material is very easy to process. Milling of the powders prior to fabrication is not necessary, although it may be used to improve processing and properties.

The fracture resistance of the material, 32 MPa $m^{1/2}$, is much higher than that listed in U.S. Pat. No. 5,045,512, which is 8 MPa $m^{1/2}$.

The material is extremely resistant to abrasion by dry wear.

Relatively coarse powders (typical diameters from about 10 to about 50 μm) were used. Depending on commercial availability, much smaller sizes can be used. Smaller sizes will in general result in better mechanical properties. Instead of prealloyed iron aluminide powders, elemental powders of iron and aluminum may also be used. Additional techniques such as milling of the mixture of iron aluminide and ceramic powders prior to liquid phase sintering may be used in order to improve the properties of the final product. This milling may be carried out dry or in a suitable wet medium. For near-net shaping, binders may be employed. Liquid phase sintering is not confined to vacuum environments, but to any environment which protects the materials from degradation during sintering, such as argon, helium, nitrogen and hydrogen. Any other consolidation techniques such as, for example, hot pressing, hot isostatic pressing, forging, and extrusion may be employed to fully densify the materials.

Any ceramic particles, such as boride, carbide, nitride, or oxide particles may be incorporated in iron aluminides. Thermodynamic compatibility calculations suggest that ceramics such as HfC, TiC, ZrC, $HfB_2$, $LaB_6$, $Al_2O_3$, $ScB_2$, BeO, $La_2O_3$, $Sc_2O_3$, $Y_2O_3$, HfN, TiN and NbC will not react with iron aluminides to form other compounds, which might degrade the properties. Those ceramics, which are not wetted by iron aluminides, such as aluminum oxide, may be included together with wettable particles such as titanium diboride (see example 6).

The iron aluminide binder of the present invention may be alloyed with elements other than iron or aluminum to improve some of its properties. As long as the binder contains a substantial amount of phases with the B2 crystal structure (the crystal structure of FeAl) or the $DO_3$ crystal structure (the crystal structure of $Fe_3Al$), it is not fundamentally different from the binary binder consisting of iron and aluminum only. In particular, if an alloying dement substitutes for aluminum sites in the binder, the aluminum concentration may be lower than 10 weight percent, yet the alloy may still consist mostly of a $DO_3$ phase. Put differently, some of the aluminum may be replaced by other elements without substantially changing the basic idea of this invention. A similar reasoning may be applied to the replacement of the iron in the binder by other elements.

Processing may be carried out by conventional powder-metallurgical techniques. Near-net shape processing is easily accomplished.

Near-theoretical densities corresponding to less than 1 vol. % residual porosity were achieved without the application of external pressure during processing. The following typical densities were obtained:

| Material | Density ($Mg/m^3$) |
|---|---|
| Iron Aluminide-$TiB_2$ | 5.3 |
| Iron Aluminide-TiC | 5.3 |
| Iron Aluminide-$ZrB_2$ | 6.0 |
| Iron Aluminide-WC | 10.0 |

Rockwell A hardnesses were determined for a range of the iron aluminide-bonded materials. The materials examined contained different volume fractions of the ceramic phase. By increasing the volume fraction of the ceramic phases, further increases in the hardness will he realized.

| Material | Hardness Rockwell A |
|---|---|
| Iron Aluminide/$TiB_2$ | 75 |
| Iron Aluminide/$ZrB_2$ | 75 |
| Iron Aluminide/TiC | 84 |
| Iron Aluminide/WC | 77 |

Three-point bend tests were employed to determine the room temperature bend strengths of various iron aluminide cermets. The results are listed below. It should be kept in mind that the bend strength will depend on the ceramic volume fraction. Therefore, these values should only be used as a rough guide.

| Material | Bend Strength (MPa) |
|---|---|
| Iron Aluminide/$TiB_2$ | 900–1300 |
| Iron Aluminide/$ZrB_2$ | 800–1350 |
| Iron Aluminide/TiC | 1050 |
| Iron Aluminide/WC | 1400 |

Fracture toughness was determined by measuring the energy absorbed during the controlled fracture of chevron-notched specimens in three-point bending. Representative $K_Q$ values are summarized below:

| Material | Fracture Toughness $K_Q$ (MPa $m^{1/2}$) |
|---|---|
| Iron Aluminide/$TiB_2$ | 25–30 |
| Iron Aluminide/$ZrB_2$ | 28 |
| Iron Aluminide/TiC | 15 |
| Iron Aluminide/WC | 20 |

Dry wear testing was carried out with a reciprocating ball moving against a flat specimen under a normal load of 25N at 5 Hz. The wear resistance of iron aluminide composites was superior to that of silicon nitride and tool steel sliding against the same counterfaces. After a total sliding distance of 100 m (5000 cycles) the following wear volumes were obtained:

| Material | Wear Relative To Tool Steel-on-Tool Steel |
|---|---|
| $Si_3N_4$ Ball on $Si_3N_4$ Flat | 1.0 |
| M-50 Ball on 0–1 Flat | 0.53 |
| $Si_3N_4$ Ball on Iron Aluminide/$TiB_2$ Flat | 0.03 |
| M-50 Ball on Iron Aluminide/$TiB_2$ Flat | 0.12 |

Preliminary studies of torch brazing in air were carried out. The following materials were all successfully brazed to steel:

Iron Aluminide-30 wt % $TiB_2$ (Iron Aluminide-30 vol. % $TiB_2$)

Iron Aluminide-55 wt % TiC (Iron Aluminide-60 vol. % TiC)

Iron Aluminide-63 wt % WC (Iron Aluminide-40 vol. % WC)

The metal matrix composites of the present invention can be used as wear parts and cutting tools, in particular cutting tools for machining aluminum or as coatings for wear parts and cutting tools. The main features of these types of materials are: low cost and easy availability of the binder material, low cost near-net shape processing, small residual porosity (<1 vol. % after processing without applied pressure), electro discharge-machinability, non-magnetic binder, high strength, high toughness, good wear behavior against metal and ceramic counterfaces and environmental friendliness (Ni or Co-free compositions available).

The metal matrix composites of the present invention can be fabricated into wear parts such as sealing rings, disc rotors, impellers, bushings, paper making drawing blades, heads for hard disks, valves, and any articles subject to extreme conditions of erosion, corrosion, oxidation, sulfidation, abrasion and heat such as in fossil energy systems. The articles may be used at low as well as elevated temperatures.

While there has been shown and described what is at present considered the preferred embodiments of the invention, it will be obvious to those skilled in the art that various changes and modifications may be made therein without departing from the scope of the invention as defined by the appended claims.

What is claimed is:

1. A metal matrix composite comprising a generally continuous intermetallic binder phase and a dispersed particulate phase throughout said generally continuous intermetallic binder phase, said generally continuous intermetallic binder phase having a melting point below iron and wets titanium diboride, zirconium diboride, titanium carbide and tungsten carbide, said dispersed particulate phase comprises particulates of a ceramic selected from the group consisting of titanium diboride, zirconium diboride, titanium carbide, tungsten carbide and mixtures thereof, said dispersed particulate phase comprising greater than 40 volume percent to about 99 volume percent of said metal matrix composite, said generally continuous intermetallic binder phase comprises iron aluminide with an aluminum content between about 10 and about 37 weight percent.

2. A metal matrix composite in accordance with claim 1 wherein said dispersed particulate phase comprises greater than 40 volume percent to about 80 volume percent of said metal matrix composite.

3. A metal matrix composite in accordance with claim 1 wherein said iron aluminide of iron and aluminum comprises about 24.4 weight percent aluminum.

4. A method for making a metal matrix composite comprising the following steps:

Step 1 providing a mixture of iron aluminide powder and particulates comprising ceramic particulates selected from the group consisting of titanium diboride, zirconium diboride, titanium carbide, tungsten carbide and mixtures thereof to form a powder mixture;

Step 2 heating said powder mixture in vacuum to form a metal matrix composite comprising a generally continuous iron aluminide binder phase and a dispersed particulate phase throughout said binder phase, said iron aluminide binder phase has a melting point below iron, cobalt, or nickel and wets titanium diboride, zirconium diboride, titanium carbide and tungsten carbide, said dispersed particulate phase comprises a ceramic; selected from the group consisting of titanium diboride, zirconium diboride, titanium carbide, tungsten carbide and mixtures thereof, said iron aluminide binder phase comprises from about 10 to 37 weight percent aluminum.

5. A method in accordance with claim 4 wherein said iron aluminide comprises about 24.4 weight percent aluminum.

6. A method in accordance with claim 4 wherein said Step 1 comprises providing a mixture of iron powder, aluminum powder and particulates comprising ceramic particulates selected from the group consisting of titanium diboride, zirconium diboride, titanium carbide, tungsten carbide and mixtures thereof to form a powder mixture.

7. A method in accordance with claim 4 wherein said Step 1 comprises providing a compacted powder mixture of iron aluminide powder and particulates comprising ceramic particulates selected from the group consisting of titanium diboride, zirconium diboride, titanium carbide, tungsten carbide and mixtures thereof.

8. An article of manufacture comprising an article selected from the group consisting of wear parts and cutting tools, said article comprising a metal matrix composite comprising a generally continuous intermetallic binder phase and a dispersed particulate phase throughout said generally continuous intermetallic binder phase, said generally continuous intermetallic binder phase having a melting point below iron, cobalt, or nickel and wets titanium diboride, zirconium diboride, titanium carbide and tungsten carbide, said dispersed particulate phase comprises particulates of a ceramic selected from the group consisting of titanium diboride, zirconium diboride, titanium carbide, tungsten carbide and mixtures thereof, said dispersed particulate phase comprises greater than 40 volume percent to about 99 volume percent of said metal matrix composite, said generally continuous intermetallic binder phase comprises iron aluminide with an aluminum content between about 10 and about 37 weight percent.

9. An article of manufacture in accordance with claim 8 wherein said wear parts are selected from the group consisting of sealing rings, disc rotors, impellers, bushings, paper making drawing blades, heads for hard disks and valves.

10. An article of manufacture comprising an article coated with a metal matrix composite, said article selected from the group consisting of wear parts and cutting tools, said metal matrix composite comprising a generally continuous intermetallic binder phase and a dispersed particulate phase throughout said generally continuous intermetallic binder phase, said generally continuous intermetallic binder phase having a melting point below iron, cobalt, or nickel and wets titanium diboride, zirconium diboride, titanium carbide and tungsten carbide, said dispersed particulate phase comprises particulates of a ceramic selected from the group consisting of titanium diboride, zirconium diboride, titanium carbide, tungsten carbide and mixtures thereof, said dispersed particulate phase comprises greater than 40 volume percent to about 99 volume percent of said metal matrix composite, said generally continuous intermetallic binder phase comprises iron aluminide with an aluminum content between about 10 and about 37 weight percent.

* * * * *